US012669306B2

(12) United States Patent
Lynds

(10) Patent No.: US 12,669,306 B2
(45) Date of Patent: Jun. 30, 2026

(54) EQUIPMENT CASE FIREARM FRAME ASSEMBLY

(71) Applicant: Pelican Products, Inc., Torrance, CA (US)

(72) Inventor: Ted Lynds, Cummington, MA (US)

(73) Assignee: Pelican Products, Inc., Torrance, CA (US)

( * ) Notice: Subject to any disclaimer, the term of this patent is extended or adjusted under 35 U.S.C. 154(b) by 0 days.

(21) Appl. No.: 18/733,330

(22) Filed: Jun. 4, 2024

(65) Prior Publication Data

US 2025/0369722 A1 Dec. 4, 2025

(51) Int. Cl.

| | |
|---|---|
| ***F41C 33/06*** | (2006.01) |
| ***A45C 5/00*** | (2006.01) |
| ***A45C 13/02*** | (2006.01) |

(52) U.S. Cl.

CPC ..... *F41C 33/06* (2013.01); *A45C 5/00* (2013.01); *A45C 13/02* (2013.01)

(58) Field of Classification Search

CPC ..... F41C 33/06; F41C 33/003; F41A 23/18; A47B 81/00

USPC ..... 206/317, 316.1, 315.11; 211/64, 60.1; 224/913; 42/94

See application file for complete search history.

(56) References Cited

U.S. PATENT DOCUMENTS 439,562 A * 10/1890 Richards ..... F41C 33/06 211/64
1,932,638 A * 10/1933 Rogers ..... F41C 33/06 206/317
1,951,255 A * 3/1934 Parker ..... A47B 81/005 211/64

(Continued)

FOREIGN PATENT DOCUMENTS

RU 195141 U1 1/2020

OTHER PUBLICATIONS

Pelican Products, Inc., 1780 Weapons Case, YouTube Video, Feb. 5, 2020, available at https://www.youtube.com/watch?v=VgY1ZdpTG_M (last accessed Sep. 4, 2024).

(Continued)

*Primary Examiner* — Steveqtruongn A. Reynolds
*Assistant Examiner* — Prince Pal
(74) *Attorney, Agent, or Firm* — Nelson Mullins Riley & Scarborough LLP

(57) ABSTRACT

An equipment case for carrying firearms. The equipment case includes a lid connected with a base to define an interior volume. The lid is movable between a closed position, at which a peripheral surface of the lid engages a peripheral surface of the base, and an open position. The peripheral surface of the base lies on a first plane. At least one frame assembly is disposed in the interior volume and includes a rear frame and a front frame. The rear frame comprises a plurality of first projections each dimensioned to receive a respective magazine well of a firearm and each defining a (Continued)

respective first projection axis. Each respective first projection axis lies on a second plane that extends at a nonzero angle to the first plane. The front frame comprises a plurality of seats dimensioned to receive the forestocks of respective firearms coupled with the rear frame.

12 Claims, 14 Drawing Sheets

(56) References Cited

U.S. PATENT DOCUMENTS 2,552,293 A * 5/1951 Page ..... B60R 7/14 224/311
2,781,897 A * 2/1957 Dale ..... F41C 33/06 220/745
3,031,069 A * 4/1962 Hirsch ..... F41C 33/06 211/64
3,780,487 A 12/1973 Munson
3,964,613 A * 6/1976 Anderson, Jr. ..... F41A 23/00 312/902
4,113,107 A * 9/1978 Jaeger ..... F41A 17/02 211/64
4,132,315 A * 1/1979 Young ..... E05B 73/00 211/64
4,438,913 A * 3/1984 Hylla ..... B25H 1/00 269/296
4,446,900 A * 5/1984 Markovich ..... A45C 13/02 206/523
4,548,392 A * 10/1985 Rickling ..... F41A 23/00 269/275
4,823,673 A * 4/1989 Downing ..... F41A 23/34 89/37.04
4,824,086 A * 4/1989 Rickling ..... F41A 23/00 269/275
4,873,777 A * 10/1989 Southard ..... A47B 81/005 211/64
4,971,208 A * 11/1990 Reinfried, Jr. ..... A47B 81/005 211/64
4,998,944 A * 3/1991 Lund ..... F41A 23/18 248/316.5
5,058,302 A * 10/1991 Minneman ..... F41A 23/18 206/315.11
5,070,636 A * 12/1991 Mueller ..... F41A 23/16 73/167
5,350,094 A * 9/1994 Morford ..... B60R 7/14 224/570
5,454,931 A * 10/1995 Lauve, Jr. ..... F41A 23/18 312/265.5
5,669,495 A * 9/1997 West ..... A45C 5/03 190/110
5,676,257 A * 10/1997 Adkins ..... A47B 81/005 211/64
5,678,686 A * 10/1997 Hagemann ..... F41C 33/06 206/315.11
5,779,120 A * 7/1998 Morford ..... B60R 7/14 224/570
5,811,720 A * 9/1998 Quinnell ..... F41A 23/16 89/37.04
6,119,858 A * 9/2000 Davidson ..... A01K 97/08 206/315.11
6,142,313 A * 11/2000 Young ..... F41A 23/18 42/70.11
6,457,618 B1 * 10/2002 Hancock ..... B60R 7/14 224/558
6,526,687 B1 * 3/2003 Looney ..... F41A 23/16 42/94
6,547,070 B1 * 4/2003 Kolpin ..... F41C 33/06 190/110
6,880,698 B2 * 4/2005 Fiore, Jr. ..... F41B 5/1457 292/249
7,137,511 B1 * 11/2006 Crowell ..... F41A 23/18 248/176.1
7,281,346 B1 * 10/2007 Cook ..... F41A 23/02 206/315.11
7,513,633 B2 * 4/2009 Ermeti ..... F21L 4/005 362/208
7,584,690 B2 * 9/2009 Cauley ..... F41A 23/18 89/37.04
8,245,431 B2 * 8/2012 Werner ..... F41A 23/16 73/167
8,307,576 B1 * 11/2012 Bogart ..... F41A 23/16 248/176.1
8,429,798 B1 * 4/2013 Paigen ..... A44B 11/04 224/150
D687,247 S * 8/2013 Meeks ..... D6/552
8,651,289 B2 * 2/2014 Diaz, Jr. ..... A01K 97/08 206/315.11
8,727,294 B1 * 5/2014 Harms ..... F41C 33/041 224/198
8,752,745 B2 * 6/2014 Bond ..... B62J 9/30 224/912
8,931,201 B2 * 1/2015 Gianladis ..... F41A 23/18 42/94
8,950,596 B2 * 2/2015 Arabian ..... G07C 9/30 211/64
9,345,323 B1 * 5/2016 Kubiniec ..... A47B 81/005
9,733,036 B2 * 8/2017 Tucker ..... F41A 23/18
10,144,358 B2 * 12/2018 Fife ..... A47F 5/08
10,399,503 B2 * 9/2019 McDonald ..... F41A 23/18
10,576,900 B2 * 3/2020 Bornais ..... F41A 23/18
11,607,039 B1 * 3/2023 Thacker ..... A47B 81/005
11,889,918 B2 * 2/2024 Erbil ..... F41A 23/005
11,933,569 B1 * 3/2024 Chernik ..... F16M 11/14
12,259,213 B2 * 3/2025 Roberts ..... A45C 13/1084
12,345,485 B2 * 7/2025 Dunn ..... F41A 11/00
2002/0040858 A1 * 4/2002 Fiore, II ..... A63B 71/0036 224/916
2002/0060232 A1 * 5/2002 Stenger ..... B60R 7/14 224/916
2003/0106818 A1 * 6/2003 Fiore, Jr. ..... F41B 5/1457 206/315.11
2006/0065560 A1 * 3/2006 Dickinson ..... F41C 33/06 206/317
2007/0013478 A1 * 1/2007 Crigger ..... G07C 9/37 70/279.1
2007/0170219 A1 * 7/2007 Ballarta ..... A45F 3/04 224/645
2008/0053850 A1 * 3/2008 Daniel ..... F41C 33/06 206/317
2008/0237939 A1 * 10/2008 McDonnough ..... B29C 49/04 264/500
2010/0236125 A1 * 9/2010 Morrow ..... F41A 23/02 42/94
2010/0270201 A1 * 10/2010 Cauley ..... F41A 23/02 206/525
2011/0290837 A1 * 12/2011 Smith ..... F41A 23/26 42/70.11
2012/0037579 A1 * 2/2012 Muldoon ..... F41A 23/18 211/64
2014/0157643 A1 * 6/2014 Tucker ..... F41A 23/18 42/94
2015/0260480 A1 * 9/2015 Dunn ..... E05G 1/00 42/70.11
2015/0332528 A1 * 11/2015 McGinnis ..... E05G 1/00 109/23
2017/0122010 A1 * 5/2017 McCanna ..... A47B 81/00
2017/0361777 A1 * 12/2017 Bornais ..... B60R 7/14
2018/0027954 A1 * 2/2018 Schneider ..... F41C 33/06
2019/0107367 A1 * 4/2019 Liu ..... A45C 13/02
2020/0191522 A1 * 6/2020 Searle ..... F41C 33/06
2023/0165367 A1 * 6/2023 Erbil ..... F41C 33/06 211/64
2023/0180930 A1 * 6/2023 Honermann ..... A47F 5/0861 211/64
2024/0247910 A1 * 7/2024 Searle ..... A45C 13/02

(56) References Cited

OTHER PUBLICATIONS

Extended European Search Report dated Oct. 21, 2025, for corresponding European Application No. 25179522.5; 9 pages.

* cited by examiner

EQUIPMENT CASE FIREARM FRAME ASSEMBLY

TECHNICAL FIELD

Embodiments of the present invention relate to hard-sided equipment cases and, more particularly, certain embodiments relate to a system for supporting, storing, and/or transporting multiple sizes of specific equipment, such as but not limited to firearms, in a hard-sided case.

BACKGROUND

Hard-sided cases for storing and/or transporting various types of equipment (e.g., cameras, guns, etc.) are known. The Protector line of cases from Pelican Products, Inc., of Torrance, California is one example of this type of case. Where they are used to store and/or transport firearms, such cases typically employ foam inserts or trays (e.g., formed closed cell or open cell foam) to support the firearms within the cases.

SUMMARY

In accordance with one embodiment, the present invention provides an equipment case for carrying firearms. In this embodiment, the equipment case comprises a lid connected with a base to define an interior volume. The lid is movable between a closed position, at which a peripheral surface of the lid engages a peripheral surface of the base, and an open position. The peripheral surface of the base lies on a first plane. At least one frame assembly is disposed in the interior volume and coupled with the base. The at least one frame assembly comprises a rear frame and a front frame. The rear frame comprises a plurality of first projections each dimensioned to receive a respective magazine well of a firearm and each defining a respective first projection axis. Each respective first projection axis lies on a second plane that extends at a nonzero angle to the first plane. The front frame comprises a plurality of seats dimensioned to receive the forestocks of respective firearms coupled with the rear frame.

In accordance with another embodiment, the present invention provides a method of using an equipment case. The method comprises providing an equipment case comprising a lid connectable with a base to define an interior volume and at least one frame assembly disposed in the interior volume. The at least one frame assembly comprises a rear frame spaced apart from a front frame. The method also comprises loading a plurality of firearms into the interior volume such that a magazine well of each firearm engages the rear frame and a forestock of each firearm engages the front frame.

In some embodiments of the method, the rear frame comprises a plurality of recesses and the magazine well of each firearm is disposed in a respective one of the plurality of recesses. In other embodiments of the method, the rear frame comprises a plurality of projections and the magazine well of each firearm is disposed over a respective one of the plurality of projections. In various embodiments, each of the projections can project from a common base. Also, in certain embodiments, the method further comprises coupling a locking bar with the rear frame such that the locking bar engages each of the plurality of firearms.

In accordance with a further embodiment, the present invention provides an equipment case for carrying firearms. In this embodiment, the equipment case comprises a lid and a base, wherein the lid and base are connectable to one another to define an interior volume. The equipment case also defines a first lateral side, a second lateral side opposite the first lateral side, a front side, and a back side opposite the front side. The equipment case also comprises a first frame assembly disposed in the interior volume and coupled with the base and a second frame assembly disposed in the interior volume and coupled with the lid. The first frame assembly comprises a first rear frame comprising at least one projection engageable with a magazine well of a first firearm and a first front frame comprising at least one seat engageable with a forestock of the first firearm. The second frame assembly comprises a second rear frame comprising at least one projection engageable with a magazine well of a second firearm and a second front frame comprising at least one seat engageable with a forestock of the second firearm.

BRIEF DESCRIPTION OF THE DRAWINGS

Figure 1:
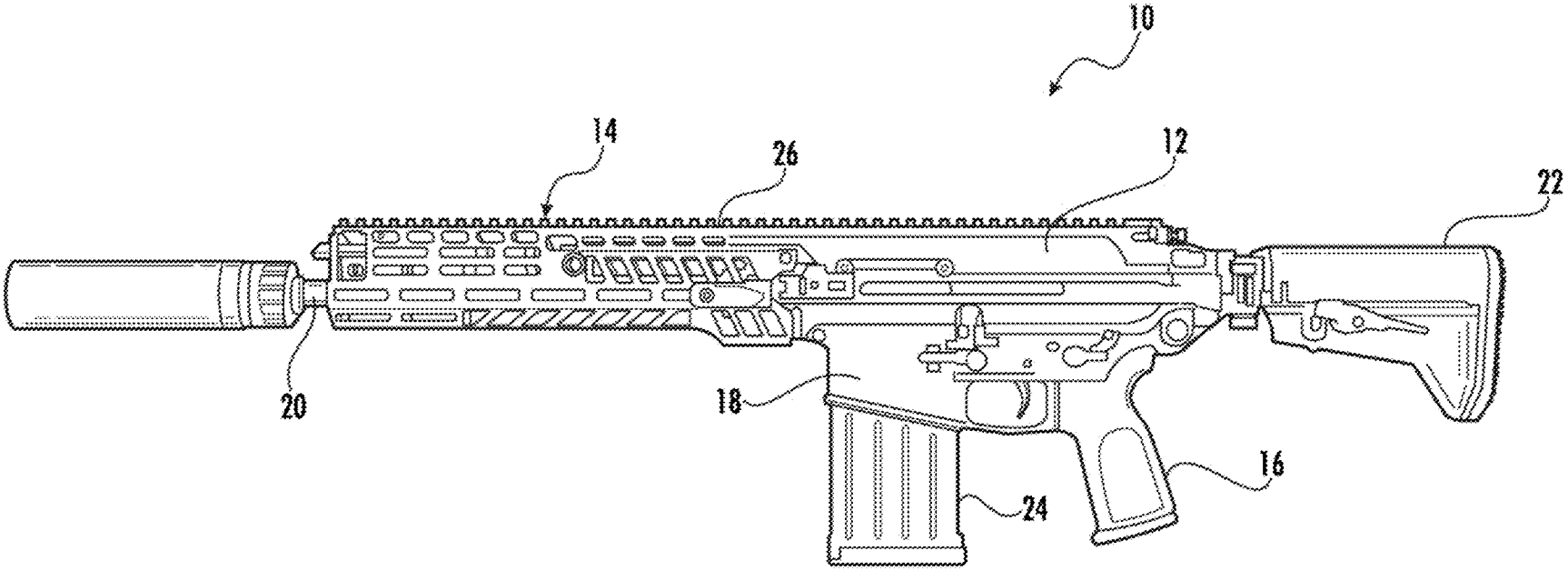
Figure 2:
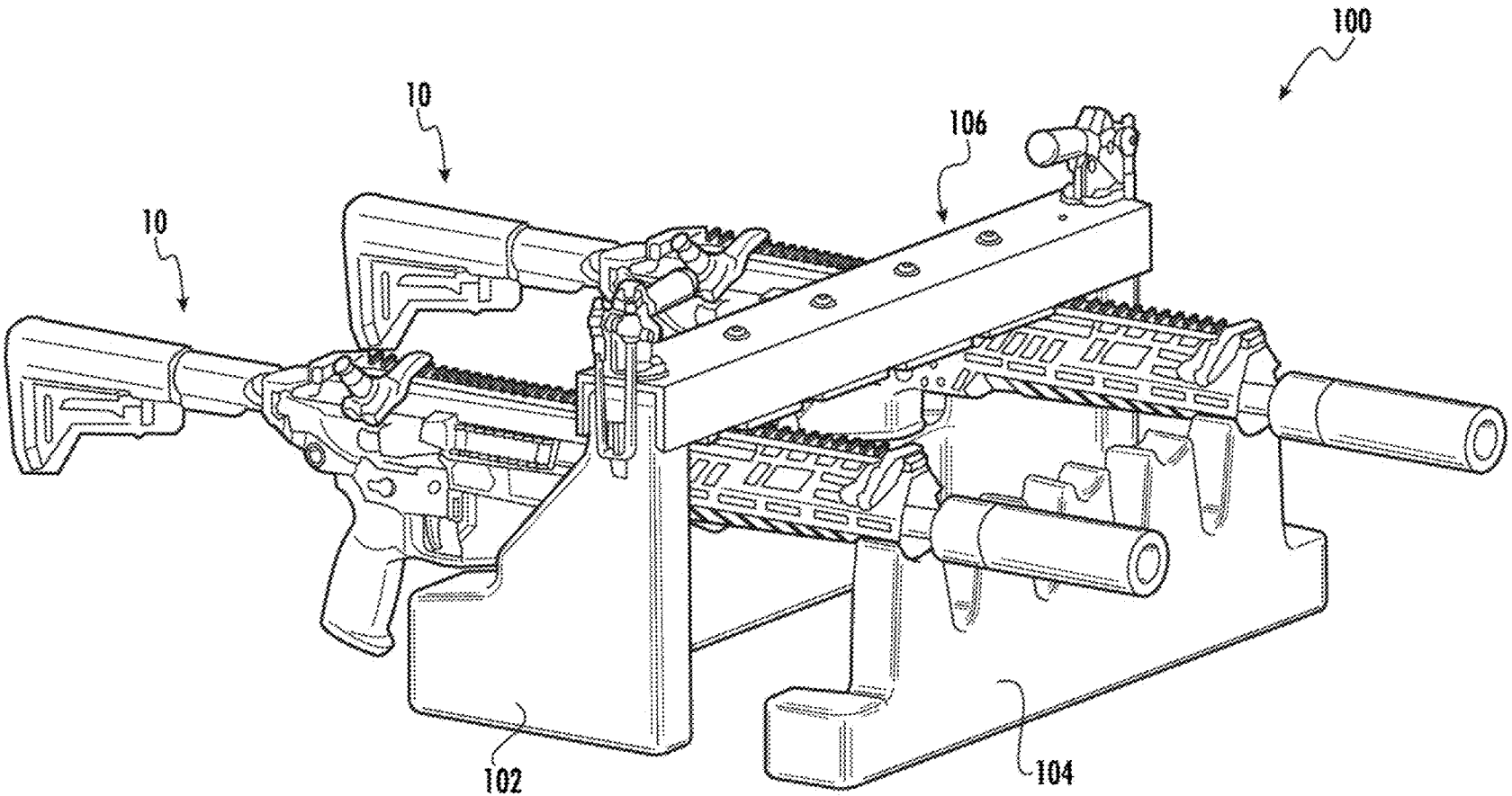
Figure 3:
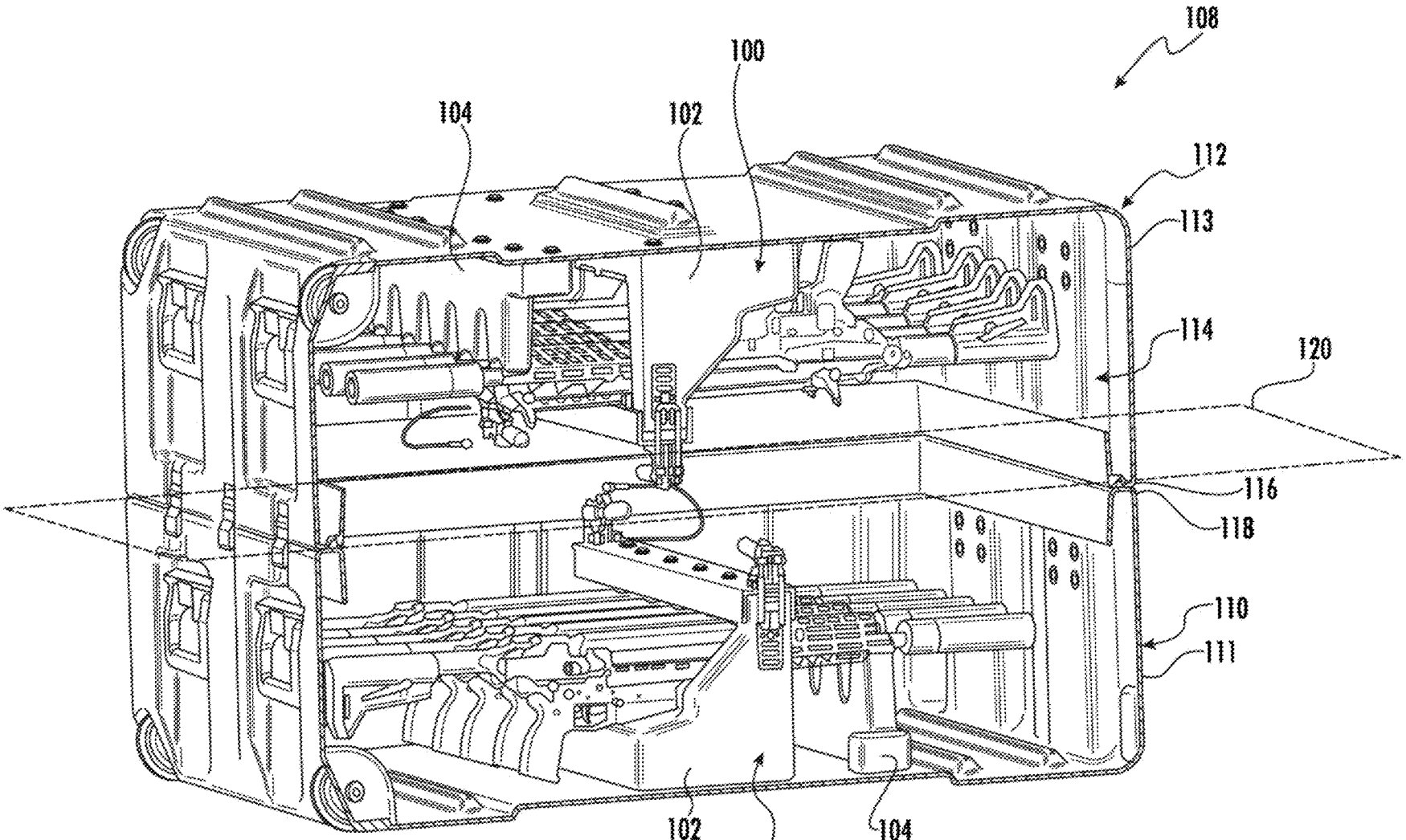
Figure 4:
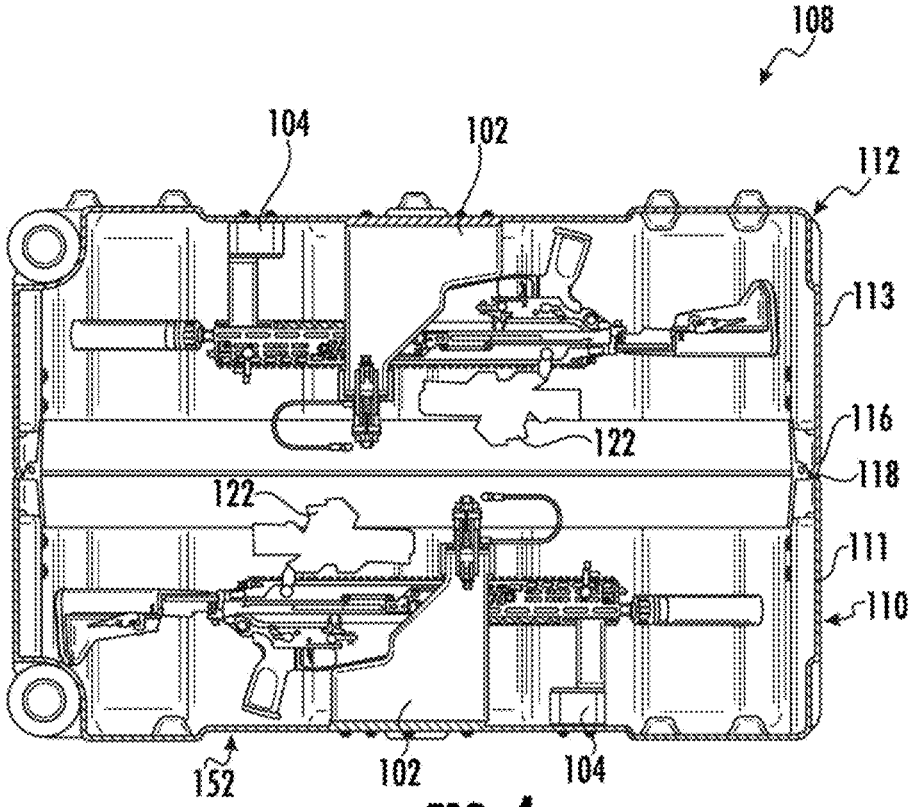
Figure 5:
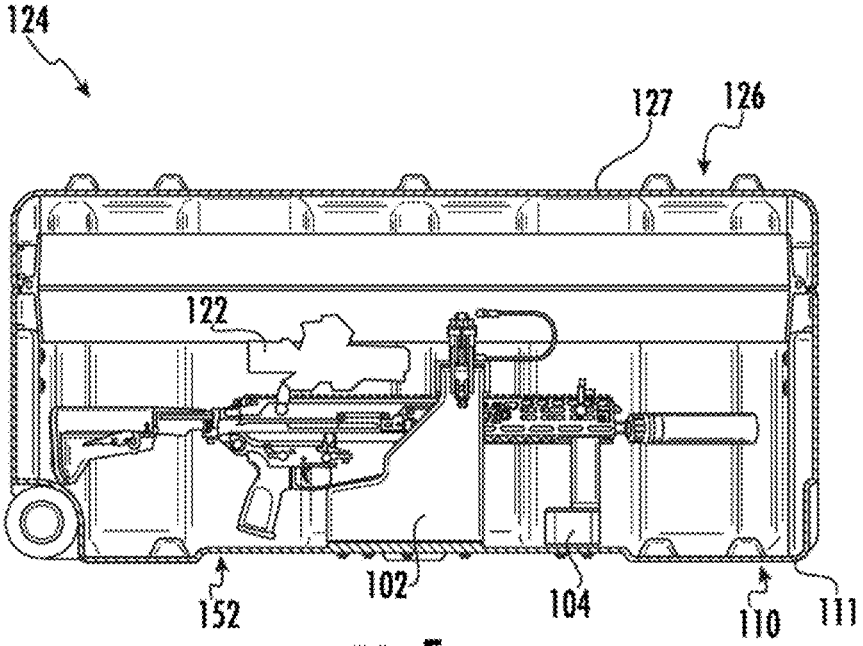
Figure 6:
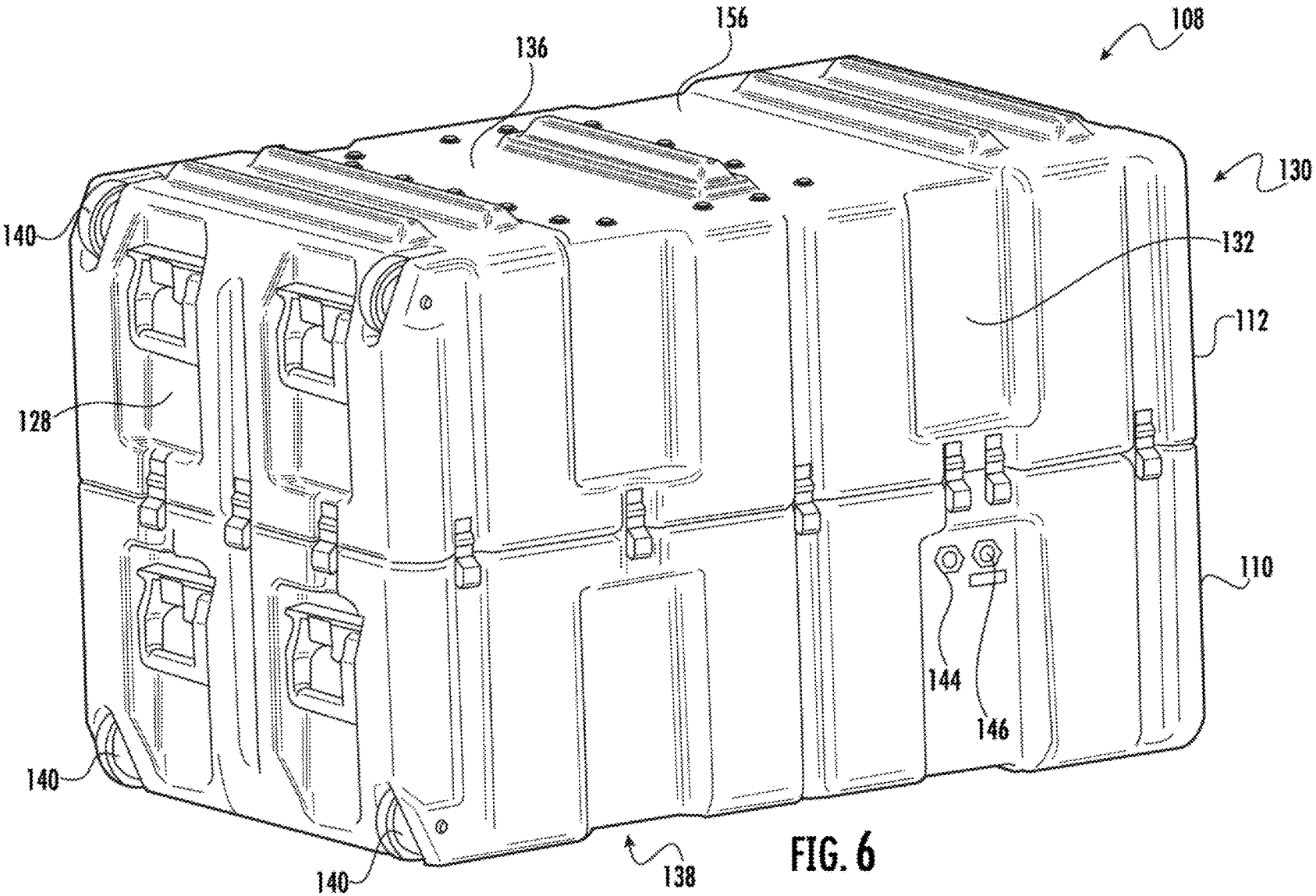
Figure 8:
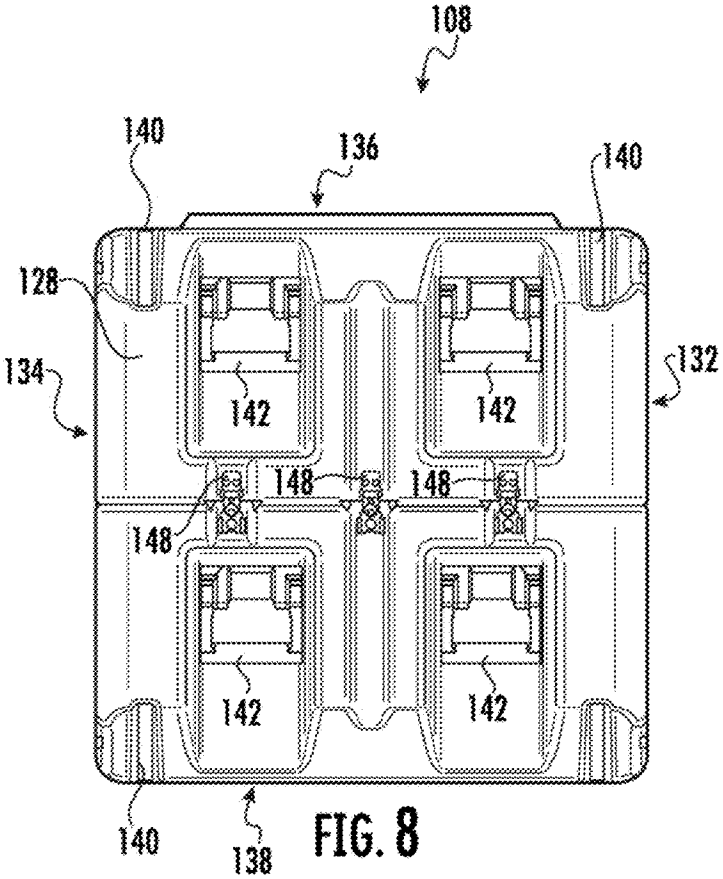
Figure 7:
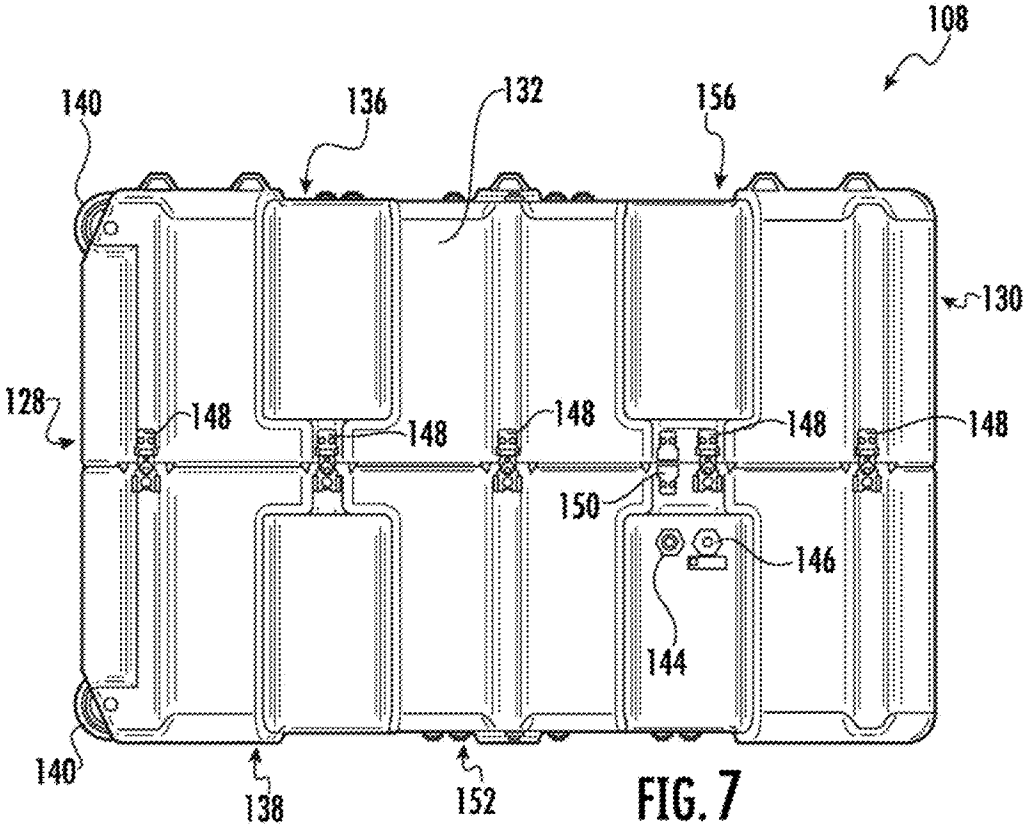
Figure 10:
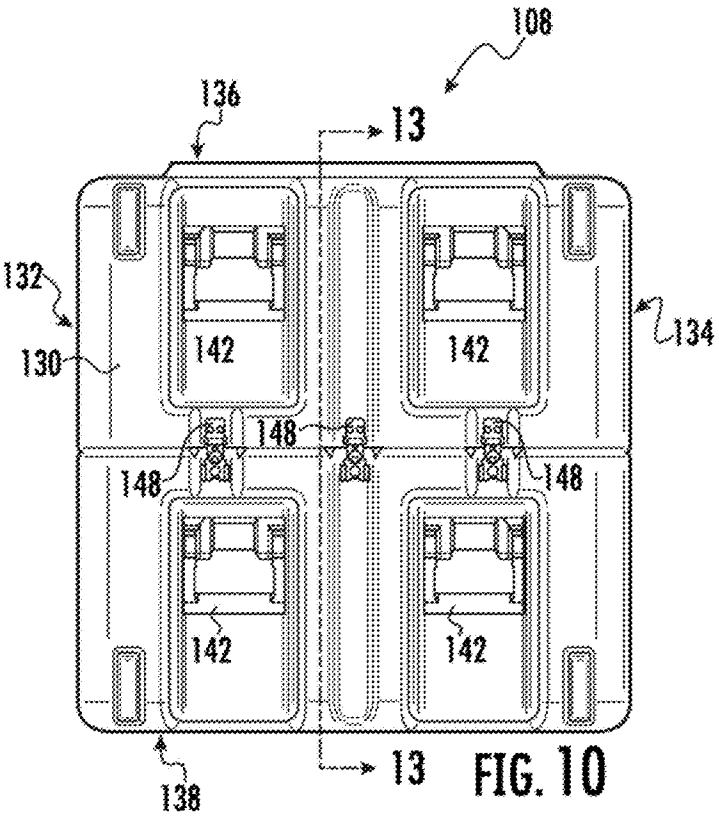
Figure 9:
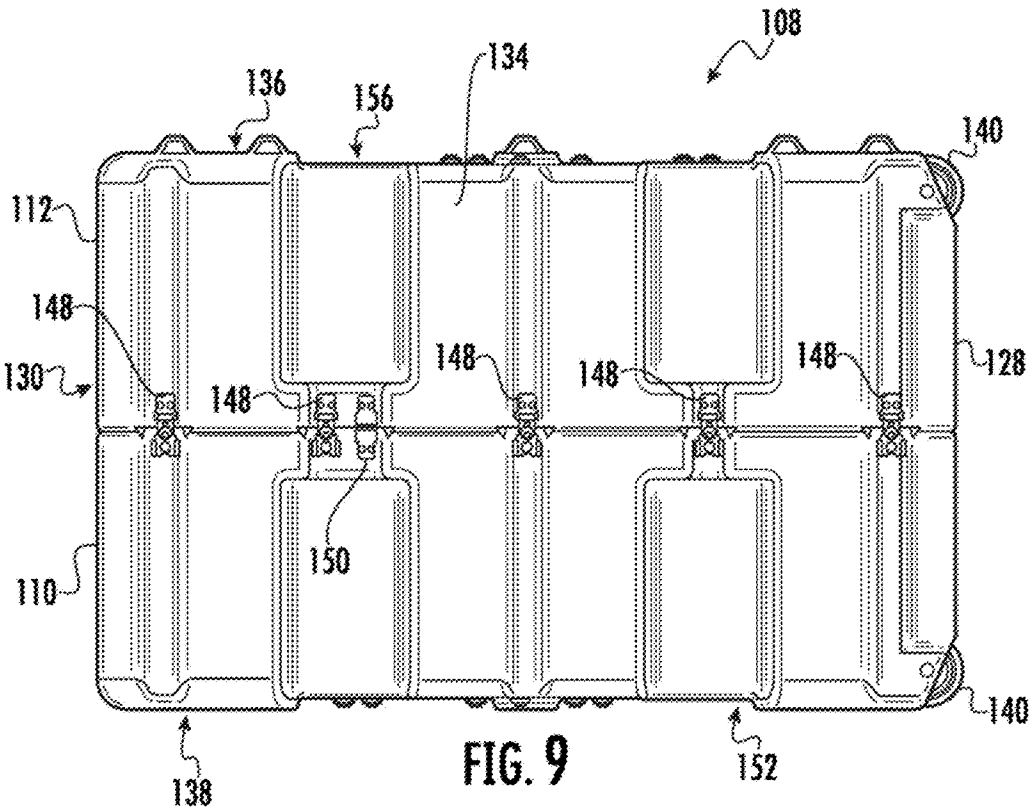
Figure 11:
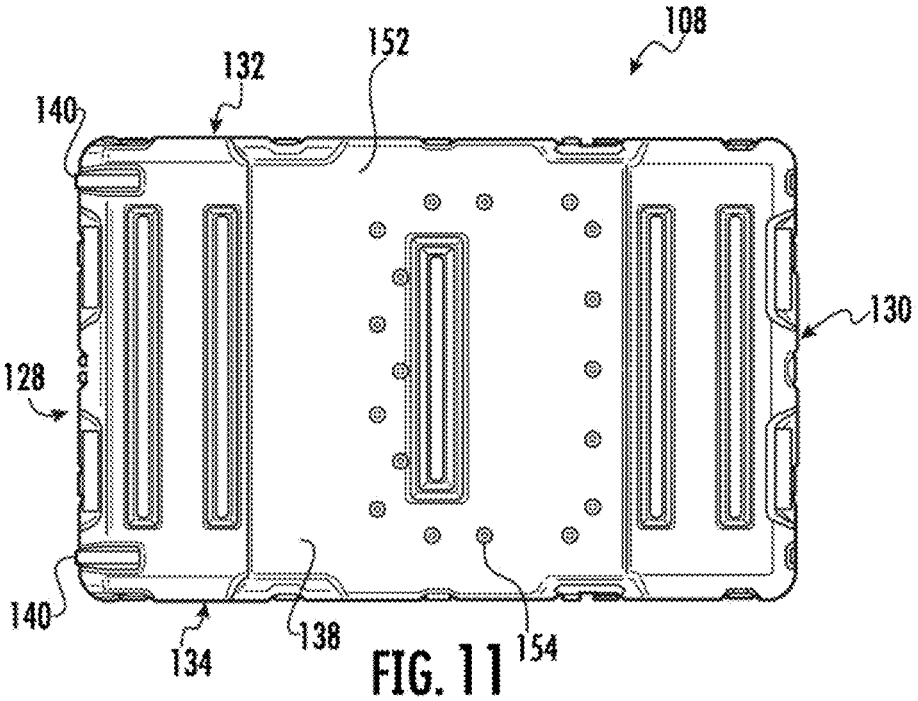
Figure 12:
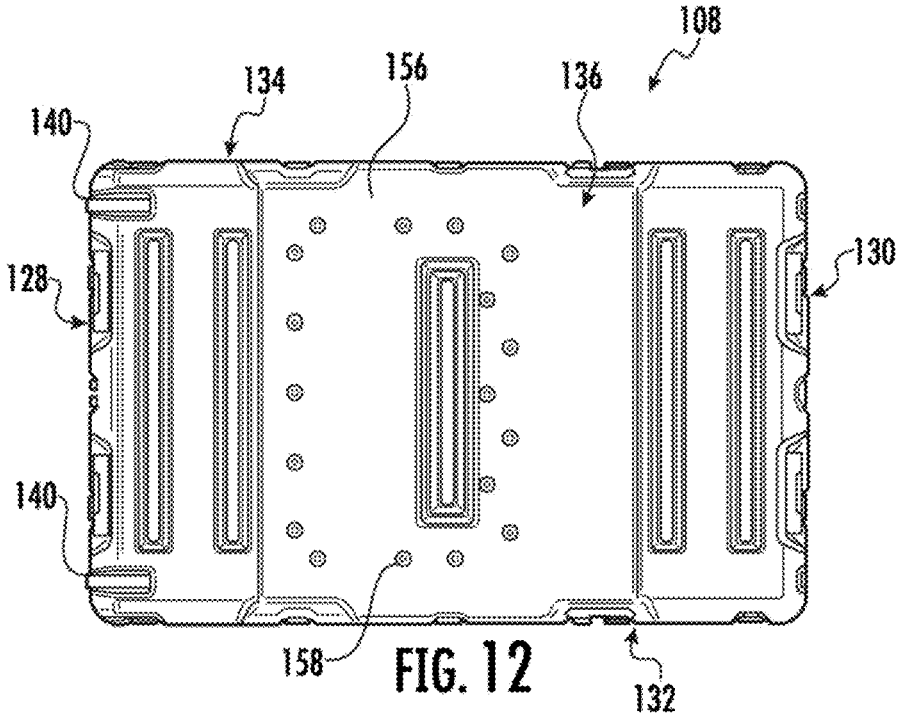
Figure 13:
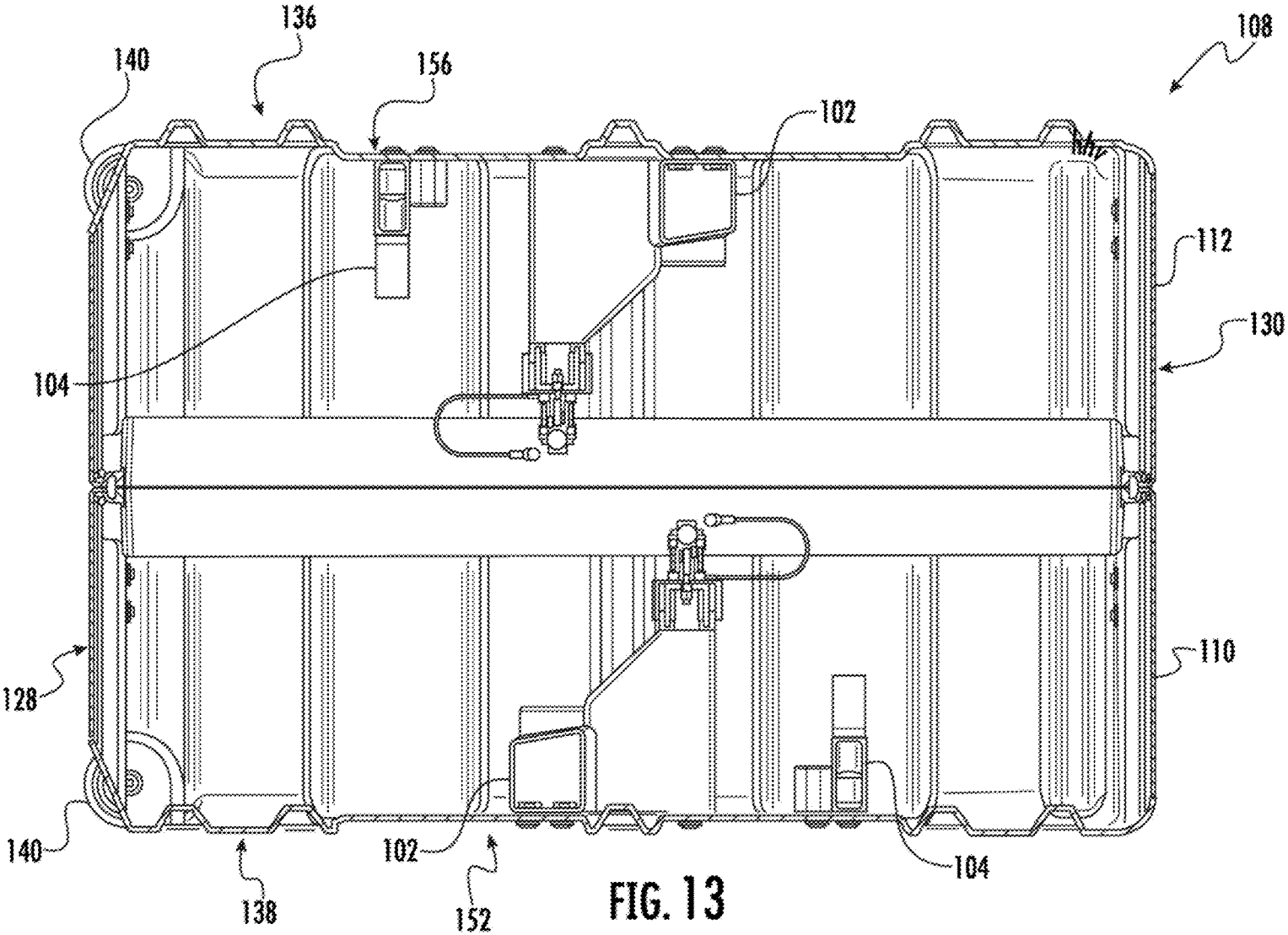
Figure 15:
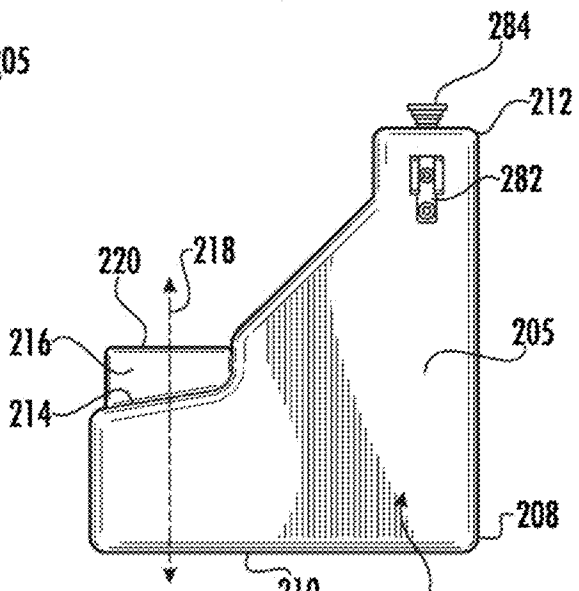
Figure 14:
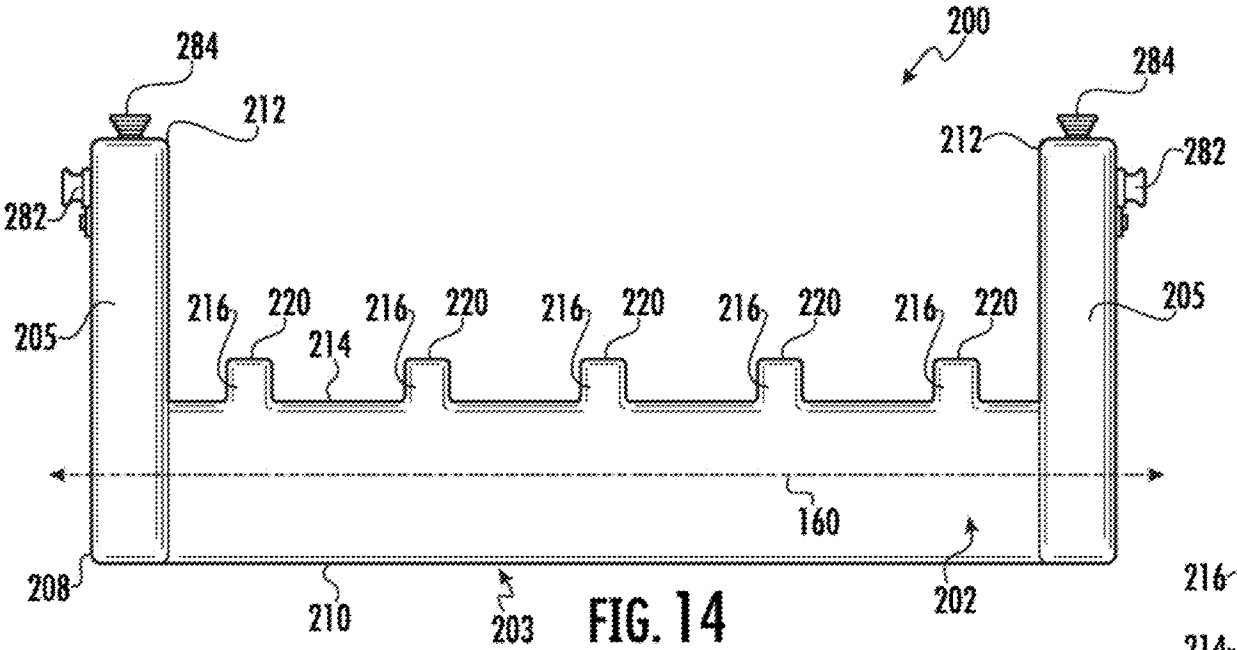
Figure 16:
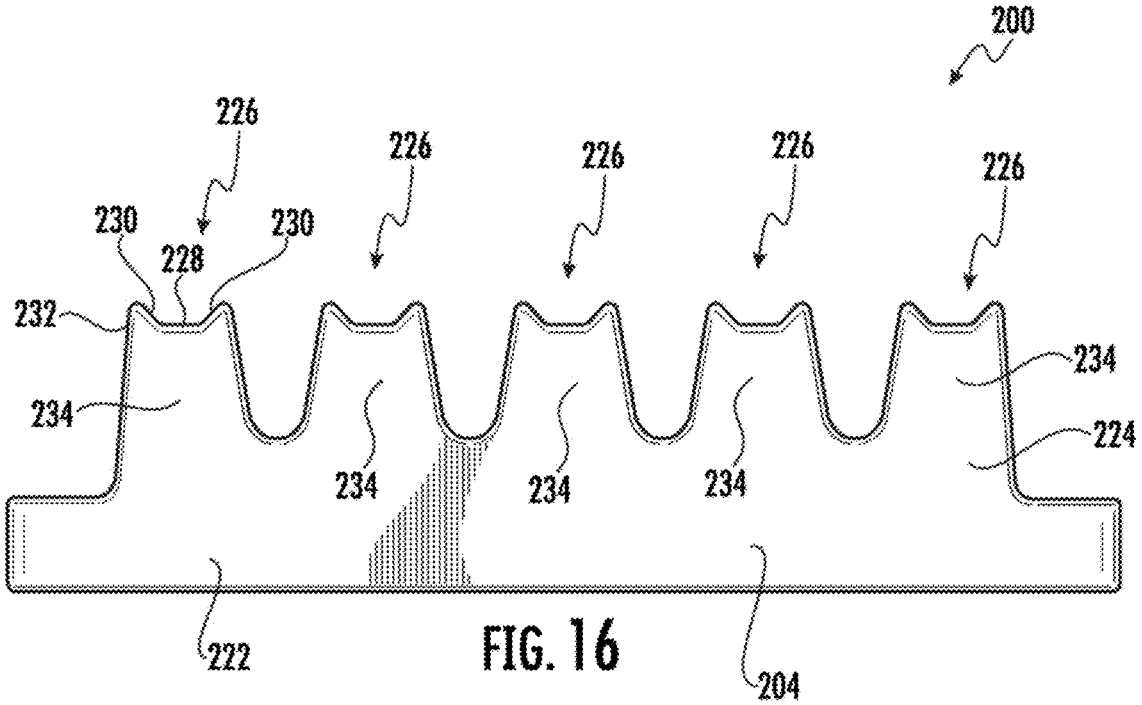
Figure 17:
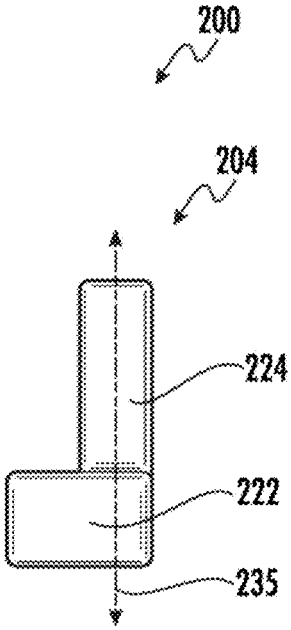
Figure 18:
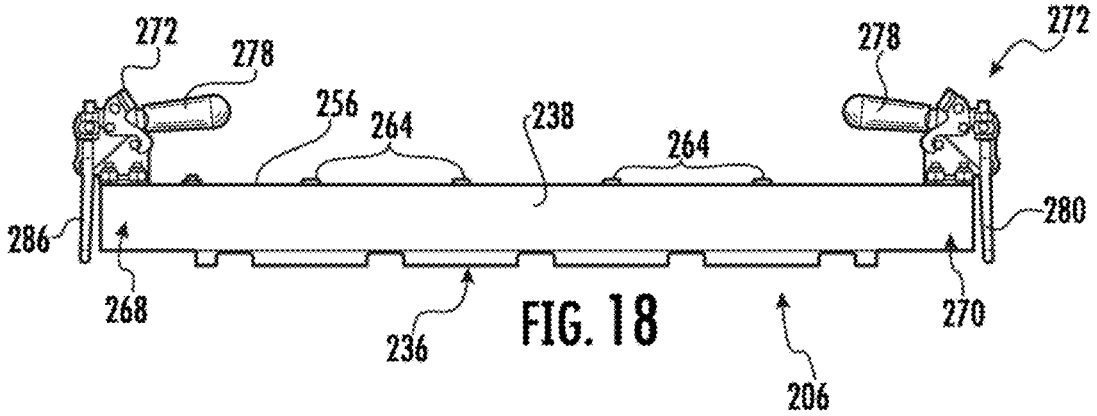
Figure 19:
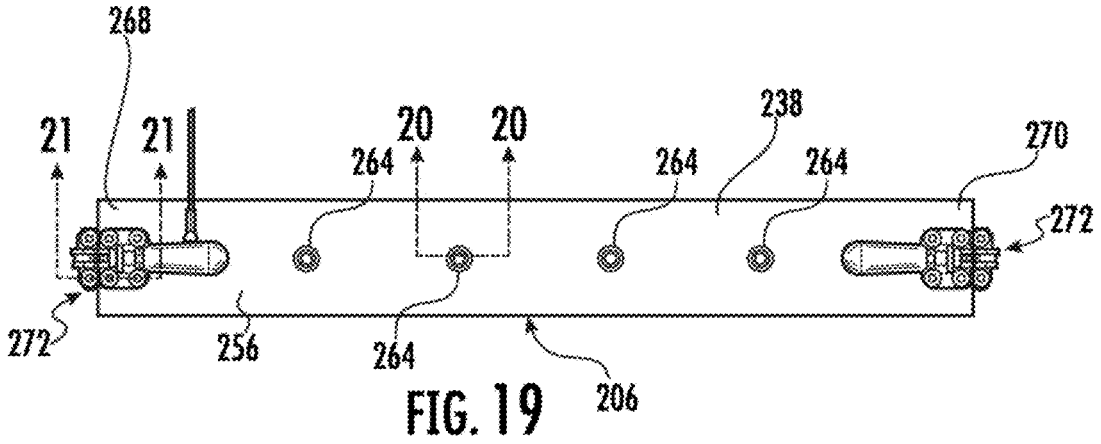
Figure 20:
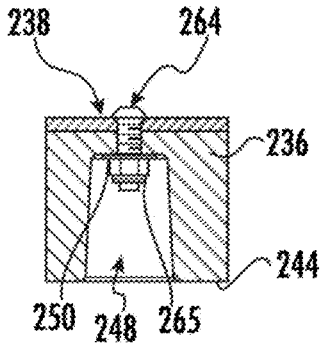
Figure 21:
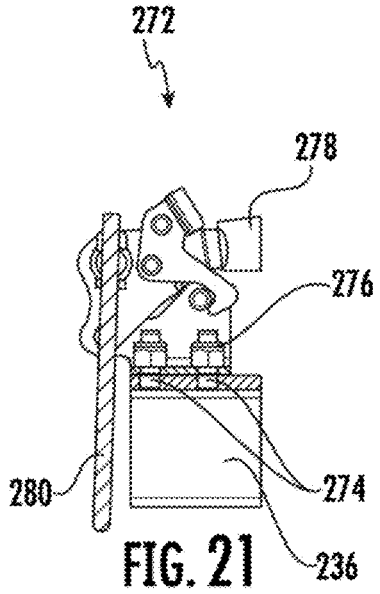
Figure 22:
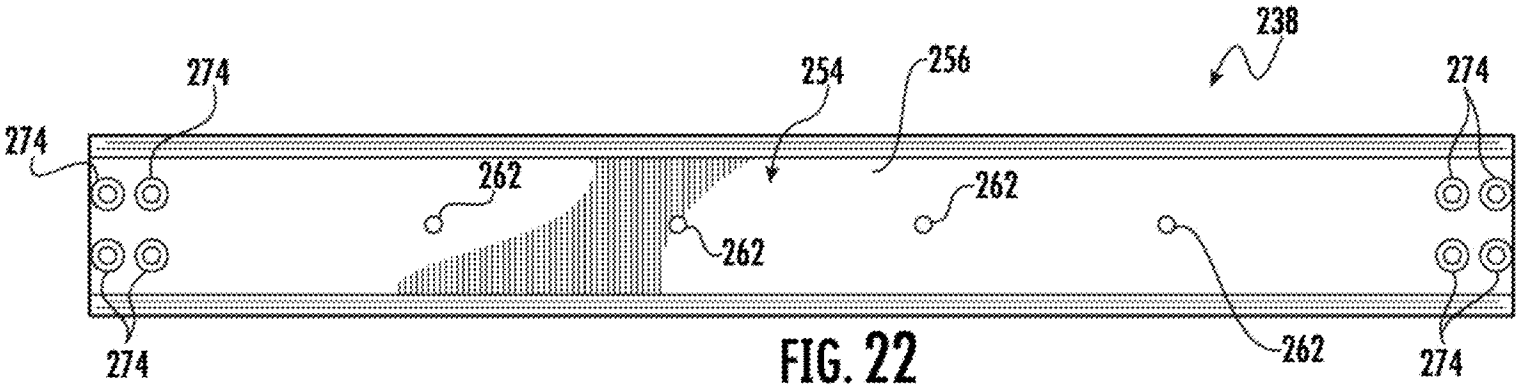
Figure 23:
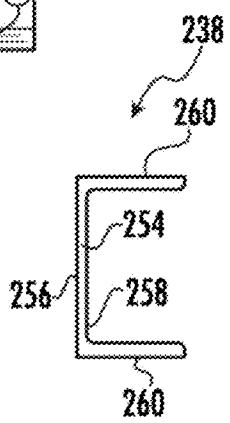
Figure 24:
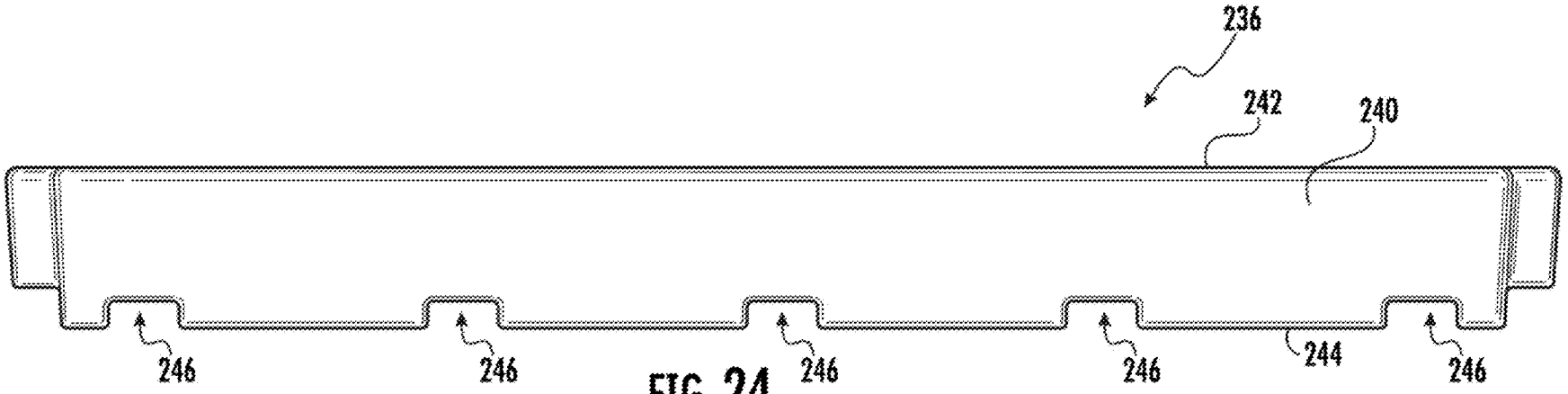
Figure 25:
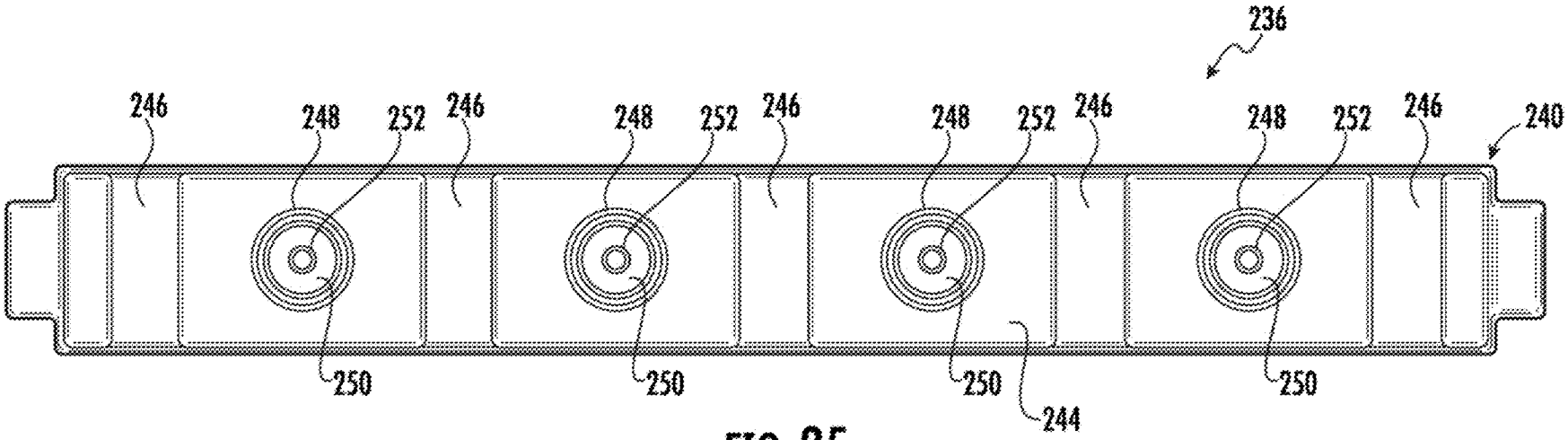

Having thus described some example embodiments in general terms, reference will now be made to the accompanying drawings, which are not necessarily drawn to scale, and wherein:

FIG. 1 is a side elevation view of an example firearm that can be used with embodiments of the present invention;

FIG. 2 is a perspective view of a frame assembly in accordance with an embodiment of the present invention in which two firearms are secured;

FIG. 3 is a perspective cross-sectional view of an equipment case including two frame assemblies storing ten (10) firearms in accordance with an embodiment of the present invention;

FIG. 4 is a side elevation view of the case of FIG. 3;

FIG. 5 is a side elevation view of an equipment case including a single frame assembly storing five (5) firearms in accordance with yet another embodiment of the present invention;

FIG. 6 is a perspective view of an equipment case in accordance with an embodiment of the present invention;

FIG. 7 is a front elevation view of the equipment case of FIG. 6;

FIG. 8 is a left side elevation view of the equipment case of FIG. 6;

FIG. 9 is a rear elevation view of the equipment case of FIG. 6;

FIG. 10 is a right side elevation view of the equipment case of FIG. 6;

FIG. 11 is a bottom plan view of the equipment case of FIG. 6;

FIG. 12 is a top plan view of the equipment case of FIG. 6;

FIG. 13 is a cross-sectional view of the equipment case of FIG. 6 taken along the line 13-13 in FIG. 10;

FIGS. 14-15 are respective front and left side elevation views of a rear frame of a frame assembly in accordance with an embodiment of the present invention;

FIGS. 16-17 are respective front and left side elevation views of a front frame of a frame assembly in accordance with an embodiment of the present invention;

FIGS. 18-19 are respective front elevation and top plan views of a locking bar that can be used with the frame assembly of FIGS. 14-17 in accordance with an embodiment of the present invention;

FIG. 20 is a cross-sectional view taken along the line 20-20 in FIG. 19 and FIG. 21 is a cross-sectional view taken along the line 21-21 in FIG. 19;

FIGS. 22-23 are respective top plan and side elevation views of a channel member that can be used with the locking bar of FIGS. 18-21 in accordance with an embodiment of the present invention; and FIGS. 24-25 are respective front elevation and bottom plan views of a support member that can be used with the locking bar of FIGS. 18-21 in accordance with an embodiment of the present invention.

Repeat use of reference characters in the present specification and drawings is intended to represent same or analogous features or elements of embodiments of the present invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of a case, container, or components thereof, such as but not limited to "vertical," "horizontal," "upper," "lower," "front," or "rear," refer to directions and relative positions with respect to the case's, firearm's, or component's orientation in its normal intended operation, as indicated in the Figures herein. Thus, for instance, the terms "vertical" and "upper" refer to the vertical direction and relative upper position in the perspectives of the Figures and should be understood in that context, even with respect to an apparatus that may be disposed in a different orientation. The term "substantially," as used herein, should be interpreted as "nearly" or "close to", such as to account for design and manufacturing tolerances of the apparatus.

Moreover, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The phrase "at least one of A and B" is satisfied by any of A alone, B alone, A and B alone, and A and B with others. The phrase "one of A and B" is satisfied by A, whether or not also in the presence of B, and by B, whether or not also in the presence of A.

Embodiments of the present invention relate to improved equipment cases and methods of using such equipment cases. In various embodiments, an equipment case can include at least one frame assembly for supporting, storing, and/or transporting various types of equipment, including but not limited to firearms. In one embodiment, a frame assembly includes a rear firearm support configured to engage the magazine wells of firearms that are to be stored in the case and a front firearm support configured to engage the respective firearm forestocks.

Although one or more preferred embodiments are discussed herein in the context of a specific type of firearm (e.g., a rifle), those of skill in the art will appreciate that the present invention is not so limited. In particular, it is contemplated that embodiments of the present invention may be used with a variety of types of firearms, including various models and sizes of rifles, handguns, and shotguns, and/or with various firearm components. Further, although various embodiments contemplate one or more frame assemblies disposed in an equipment case, in other embodiments a frame assembly can support firearm(s) in other environments and without the use of an equipment case. Additional aspects of embodiments of the present invention are described in greater detail below.

FIG. 1 illustrates an example firearm 10 that can be used in embodiments of the present invention. Here, firearm 10 is a M7 military rifle offered by Sig Sauer of Newington, NH, but firearm 10 can be any type of firearm in other embodiments, as noted above. As those of skill in the art will appreciate, among other components, firearm 10 comprises a frame or receiver 12 defining a forestock or handguard 14, a grip 16, and a magazine well 18. A barrel 20 extends from forestock 14, and a stock 22 is coupled with frame 12. A magazine 24 is received in magazine well 18 and is removable therefrom. Forestock 14 also can define a rail 26 in some embodiments.

Referring now also to FIG. 2, in embodiments of the present invention, one or more firearms 10 can be supported, for example during storage or transit in an equipment case, using a frame assembly 100. As described in more detail below, in various embodiments, frame assembly 100 comprises a rear frame 102, a front frame 104. In this context, the term "front" indicates that frame 104 is forward of frame 102 relative to a proximal end of firearm 10 (e.g., at stock 22) when frames 102 and 104 are supporting a firearm 10, and the term "rear" similarly indicates that frame 102 is rearward of frame 104 relative to the proximal end of firearm 10 when frames 102 and 104 are supporting a firearm 10. These terms are not intended to mean that frame 102 is disposed at the rear of firearm(s) 10 or an associated equipment case nor are they intended to mean that frame 104 is disposed at the front of firearm(s) 10 or an associated equipment case, although they could be in some embodiments. In some embodiments, frame assembly 100 also comprises a locking bar 106 that is configured to secure a firearm 10 to frame assembly 106, for instance at rear frame 102. Frames 102 and 104 are preferably formed from a suitable rigid but lightweight material, such as a molded plastic material (e.g., polyethylene or a copolymer thereof). In other embodiments, however, frames 102 and 104 can be formed of any suitable material.

In various embodiments, frames 102 and 104 can be attached together or spaced apart from one another and may in some embodiments comprise a single unitary frame with front and rear frame elements. In some embodiments where frames 102 and 104 are disposed in an equipment case, frames 102 and 104 can be modular. For example, frames 102 and 104 can be created with certain dimensions specific to certain firearms (or types of firearms) made by certain manufacturers in some embodiments, and they can be removable from an equipment case and replaceable with other frames 102 and 104 specific to other manufacturers' firearms (or types of firearms) to allow a given equipment case to be used with many different firearms. In other embodiments, frames 102 and 104 can be generic to certain types of firearms and/or firearm manufacturers. In certain embodiments, frames 102 and 104 can be movable relative to one another and/or to an equipment case to which they are attached to accommodate firearms of different sizes.

FIG. 3 is a perspective cross-sectional view of an equipment case 108 including two frame assemblies 100 that together store ten (10) firearms 10 in accordance with an embodiment of the present invention. In this embodiment, case 108 comprises a base 110 and a lid 112 that are connectable to one another to define an interior volume 114. In some embodiments, lid 112 can be pivotably connected with base 110, e.g., via hinges, but this is not required. Base 110 and lid 112 each can comprise a shell 111, 113, respectively, formed from a suitable rigid but lightweight material, such as a molded plastic material (e.g., polyethylene or a copolymer thereof). Shells 111, 113 in this embodiment each resemble an open-topped box-like structure, but shells 111 and 113 can have any suitable shape in other embodiments.

Preferably, lid 112 is movable between a closed position (shown), at which a peripheral surface 116 of the lid 112 engages a peripheral surface 118 of the base 110, and an open position (not shown). The peripheral surfaces 116 and/or 118 of the lid 112 and/or base 110 lie on a first plane 120. In other words, in this embodiment, a plane 120 is defined at the interface between the lid 112 and base 120. In various embodiments, a suitable gasket material can be provided on either or both of the peripheral surfaces 116, 118.

In this embodiment, within the interior volume 114, one of the frame assemblies 100 is disposed entirely within base 110 and the other of frame assemblies is disposed entirely within the lid 112. More specifically, the base 110 here is sized such that a frame assembly 100 and the five firearms 10 secured therein are disposed within the portion of interior volume 114 defined by the shell 111 of base 110 and plane 120. Similarly, the lid 112 here is sized such that a frame assembly 100 and the five firearms 10 secured therein are disposed within the portion of interior volume 114 defined by the shell 113 of lid 112 and plane 120. Thus, when lid 112 is in the closed position relative to base 110, the frame assembly 100 and the firearm(s) 10 secured therein are positioned vertically opposite the frame assembly 100 and the firearm(s) 10 that are disposed in base 110. In other embodiments where two frame assemblies 100 are disposed within a case 108, however, each frame assembly 100 need not be disposed entirely within the lid and/or base and, for example, portions of each frame assembly 100 can extend beyond a given plane 120.

Referring now also to FIG. 4, as a result of the size of case 108 and configuration of frame assemblies 100, in some embodiments firearms 10 can be secured in frame assemblies 100 with scopes 122 or other optics attached, even when the lid 112 is closed. For instance, rear frame 102 can be configured so that, when a firearm 10 is stored therein, the locking bar 106 is disposed forward of any optics and can close relative to rear frame 102 without interfering with the optics. As will be appreciated, allowing firearms 10 to be stored and transported without having to detach and separately secure or store the associated optics saves time and is more convenient for the user.

FIG. 5 illustrates another embodiment of an equipment case. In this embodiment, an equipment case 124 comprises a single frame assembly 100 storing five (5) firearms 10, rather than two frame assemblies 100 as described above. In particular, case 124 comprises a base 110 defining a shell 111 in which a frame assembly 110 is secured. Case 124 here also comprises a lid 126 defining a shell 127. Shell 127 of lid 126 has smaller dimensions than shell 113 of lid 112, and a frame assembly 100 is not secured in lid 126.

FIGS. 6-12 are several views of equipment case 108 in accordance with an embodiment of the present invention. As shown, equipment case 108 defines a first lateral side 128, a second lateral side 130 opposite the first lateral side 128, a front side 132, and a back side 134 opposite the front side 132. Equipment case 108 further defines a top side 136 and a bottom side 138 opposite the top side 136. In this embodiment, equipment case 108 comprises a plurality of wheels 140 coupled, for example, with first lateral side 128, and a plurality of handles 142 coupled with both first lateral side 128 and second lateral side 130. Further, equipment case 108 can comprise a humidity indicator 144 and a pressure relief valve 146.

In this example, when a user desires to access the contents of equipment case 108, the lid 112 is fully separable from base 110 so that the lid 112 can be placed with top side 136 facing the ground. In this position, the frame assembly 100 and firearms 10 included in lid 112 will be oriented in an upright fashion, rather than upside down as when lid 112 is connected with base 110 and bottom side 138 is disposed on the ground. In this regard, equipment case 108 comprises a plurality of latching mechanisms 148 disposed on each of sides 128, 130, 132, and 134. Here, sixteen (16) such latching mechanisms 148 are shown. The latching mechanisms 148 can comprise, for example, a catch disposed on one of base 110 and lid 112 and a strike plate disposed on the other of base 110 and lid 112. Further, padlock hasps 150 are disposed on both front side 132 and back side 134 in this embodiment.

A frame assembly 100 can be releasably attached to a case 108 or 126 in various orientations in various embodiments. For example, in cases 108 and 124, the base 110 defines a recessed portion 152 in an exterior surface of shell 111. Recessed portion 152 is positioned, e.g., opposite plane 120. As best seen in FIG. 11, rear frame 102 and front frame 104 of frame assembly 100 are attached to base 110 at recessed portion 152 via mechanical fasteners 154 in this embodiment. When firearm(s) 10 are secured in frame assembly 100 of base 110 in this embodiment, the magazine well(s) 18 will face bottom surface 138. To accommodate the dimensions of the firearm(s) 10 to be stored in base 110, the components of frame assembly 100 can be located at any position within recessed portion 152. Further, in some embodiments, the components of frame assembly 100 can comprise, e.g., a plurality of apertures sized to receive mechanical fasteners 154 (e.g., bolts or the like) that are located in a variety of predetermined positions to allow for the position of frame assembly 100 in base 110 to be adjusted without changing the position of mechanical fasteners 154. Further, in case 108 (but not in case 124), lid 112 defines a recessed portion 156 analogous to recessed portion 152 at which the frame assembly 100 of lid 112 is attached via mechanical fasteners 158 (FIG. 12). When firearm(s) 10 are secured in frame assembly 100 of lid 112 in this embodiment, the magazine well(s) 18 will face top surface 136.

Further, as shown in FIG. 14, each rear frame 102 defines a respective longitudinal axis 160. In the embodiments of cases 108 and 124 shown in FIGS. 3-5 and 13, the frame assemblies 100 are disposed in cases 108 and 124 such that the respective longitudinal axes 160 of each rear frame 102 extend between the front side 132 and the back side 134 of each equipment case. In other embodiments, however, the frame assemblies 100 can be disposed in cases 108 and 124 such that the respective longitudinal axes 160 of each rear frame 102 extend between the first lateral side 128 and the second lateral side 130 of each equipment case. Also, as best seen in FIG. 13, in the illustrated embodiment of case 108, front frame 104 of frame assembly 100 of lid 112 is disposed between rear frame 102 and first lateral side 128, whereas front frame 104 of frame assembly 100 of base 110 is disposed between rear frame 102 and second lateral side 130. In other embodiments, the reverse could be true. Likewise, in some embodiments, both frame assemblies 100 are oriented directly opposite one another about plane 120 when lid 112 is in a closed position with respect to base 110. Both front frames 104 thus could be disposed between their respective rear frames 102 and first lateral side 128, or between their respective rear frames 102 and second lateral side 130.

An embodiment of a frame assembly 200 comprising a rear frame 202, a front frame 204, and a locking bar 206 will now be described with reference to FIGS. 14-25. Referring first to FIGS. 14-15, illustrated are respective front and left side elevation views of rear frame 202 of frame assembly 200 in accordance with an embodiment of the present invention. In this embodiment, rear frame 202 comprises a base 203 extending longitudinally between a pair of laterally opposing sidewalls 205. As shown, sidewalls 205 extend from a proximal portion 208 adjacent a bottom surface 210 of base 203 and a distal portion 212 located above a top surface 214 of base 203. In general, the height of sidewalls 205 relative to base 203 will depend on the size and dimensions of the firearm(s) 10 to be secured therein, for example to position a locking bar as described below between sidewalls 205 such that it engages each firearm 10. Sidewalls 205 may be integrally formed with (e.g., by rotational molding) or releasably fastened with base 203.

As noted above, in various embodiments rear frame 202 is configured such that a magazine well 18 of each firearm 10 engages or interlocks with the rear frame 202. In the illustrated embodiment, base 203 of rear frame 202 comprises a plurality of projections 216 each dimensioned to receive a respective magazine well 18 of a firearm 10 and each defining a respective first projection axis 218 (FIG. 15). The plurality of projections 216 are preferably dimensioned such that the magazine well 18 of each firearm 10 can be snugly but removably disposed over a respective one of the plurality of projections 216. Here, rear frame 202 comprises five (5) projections 216, but any number of projections 216 could be provided in other embodiments. In an alternative embodiment, instead of projections 216, rear frame 202 comprises a plurality of recesses formed in base 203 and sized such that the magazine well 18 of each firearm 10 can be disposed in a respective one of the plurality of recesses.

In the illustrated embodiment, each of the projections 216 projects upwardly from base 203, and sidewalls 205 are disposed laterally of the plurality of projections 216. While base 203 is illustrated here as being common to each of the projections 216, that is not required. In some embodiments, rear frame 202 could comprise unitary sidewalls 205 and unitary projections 216, none of which are attached to a common base.

When rear frame 202 is coupled with either of cases 108, 124, each respective projection axis 218 lies on a plane that is perpendicular to either the front side 132 or the rear side 134 and that extends at a nonzero angle to plane 120. In one embodiment, the nonzero angle is about ninety (90) degrees. In another embodiment, the nonzero angle could be between about forty-five (45) degrees and about ninety (90) degrees. In another embodiment, the nonzero angle could be between about seventy-five (75) degrees and about eighty-five (85) degrees. In certain embodiments, each respective projection axis 218 lies on a plane that is perpendicular to either the first lateral side 128 or the second lateral side 130 and that extends at a nonzero angle to plane 120. The nonzero angles may vary as described above. In certain other embodiments, each respective projection axis 218 lies on a plane that is at a nonzero angle with respect to both plane 120 and with respect to any of sides 128, 130, 132, and/or 134. Further, while all of the projection axes 218 can be parallel to one another and lie along a single plane, as shown in FIGS. 14-15, that is not required. Instead, projection axes 218 can each lie on different planes from one another and can be non-parallel in some embodiments.

The shapes and dimensions of base 203 and projections 216 will depend on the shapes and dimensions of the firearms 10 and their respective magazine wells 18 that are to be secured in rear frame 202 and the desired orientation of firearms 10 ones secured in rear frame 202. In this embodiment, rear frame 102 is intended to secure firearms 10 in a generally upright position such that, for example, a longitudinal axis of each barrel 20 is parallel with plane 120 of cases 108 and/or 124. To accomplish this for the firearm 10 illustrated in FIG. 1, top surface 214 of base 203 is disposed at an angle to a top surface 220 of each projection 216, which top surface 220 can be parallel with bottom surface 210. Of course, other dimensions and orientations are contemplated to accommodate other firearms 10.

Additionally, sidewalls 205 in this embodiment define a shape that, when viewed from the side as shown in FIG. 15, is generally tapered between proximal portion 208 and distal portion 212. Further, distal portion 212 is spaced apart from the locations of projections 216. This offset preferably allows a locking bar as described below to be secured over each firearm 10 without requiring a scope 122 to be removed therefrom. The relative spacing between distal portion 212 and each projection 216 will vary depending on the dimensions of the firearm(s) 10 to be secured to rear frame 202.

Next, FIGS. 16-17 are respective front and left side elevation views of a front frame 204 of frame assembly 200 in accordance with an embodiment of the present invention. Here, front frame 204 comprises a base 222 extending longitudinally beneath a body portion 224. In this embodiment, front frame 204 does not comprise sidewalls analogous to those described above, but it could in other embodiments. Front frame 204 is configured to engage and/or support the forestocks 14 of the firearm(s) 10 that are engaged with rear frame 202. Thus, in this embodiment, front frame 204 defines a plurality of seats 226 dimensioned to receive the forestocks 14 of respective firearms 10 that are coupled with rear frame 202. Seats 226 can have any suitable cross-sectional shape, such as semi-circular, but in this embodiment seats 226 comprise a flat bottom surface 228 extending between two opposing, upwardly angled surfaces 230. The shape of each seat 226 will depend on the dimensions of the firearm(s) 10 to be secured therein.

In this embodiment, each seat 226 is defined in a distal portion 232 of a plurality of projections 234 that project upwardly from body portion 224. It will be appreciated that, where provided, the number of projections 234 and seats 226 provided in front frame 204 will correspond to the number of projections 216 provided in rear frame 202. In other embodiments, however, the plurality of seats 226 could be defined in body portion 224 and discrete projections 234 need not be defined. Additionally, while in this embodiment body portion 224 and projection 234 are shown extending from a common base 222, that is not required. Again, in some embodiments, front frame 204 could comprise discrete or separate bodies or projections that define the respective seats 226. Also, in various embodiments, body portion 224 and/or projections 234 can be integrally formed together with base 222 or releasably fastened therewith. Finally, each of the projections 234 can define respective projection axes 235 analogous to projection axis 218 described above. The projection axes of projections 234 all may lie on the same plane and the plane may extend at a nonzero angle to plane 120 when front frame 204 is coupled with an equipment case 108, 124. The axes of each respective projection 234 in front frame 204 can be parallel and co-planar with the axes 218 of the corresponding respective projection 216 in rear frame 202, but that is not required.

Finally, as noted above, frame assembly 200 comprises locking bar 206 in this embodiment. Referring to FIGS. 18-25, locking bar 206 comprises a longitudinal bar member 236 coupled with a channel 238. As noted above, locking bar 206 is configured to be coupled with rear frame 202 such that the locking bar 206 engages each of the plurality of firearm(s) 10 that are coupled with rear frame 202. In various embodiments, bar member 236 can be formed of a suitable rigid plastic material, such as molded polypropylene or a copolymer thereof, and channel 238 can be formed of a suitable lightweight, high-strength metal material, such as aluminum. In general, locking bar 206 is designed to withstand the applied forces seen during normal deployment and use of the case 108, 124.

Bar member 236 in this embodiment defines a body portion 240 having an upper surface 242 and a lower surface 244. Body portion 240 defines a plurality of notches 246 in lower surface 244. Notches 246 are defined such that they will be located in facing opposition with the plurality of seats 226 when the locking bar 206 is in a locked position over the plurality of firearms 10 coupled with rear frame 202. Notches 246 may, for instance, be dimensioned to align with and/or receive the rails 26 of firearms 10, but in various embodiments, notches 246 are dimensioned to support and engage the specific type of firearms 10 to be stored in rear frame 202. Body portion 240 also defines a plurality of recesses 248 that extend, for example, between bottom surface 244 and a proximal surface 250 (FIGS. 20, 25). In each recess 248, an aperture 252 is defined that extends between proximal surface 250 and top surface 242.

Channel 238 can be "C"-shaped in cross section (FIG. 23), for example comprising a longitudinal body 254 defining a top surface 256 and an opposite bottom surface 258. A pair of laterally opposed sidewalls 260 depend from body 254 and are spaced relative to one another such that bar member 236 can be snugly received therebetween. Channel 238 is configured to be received over and releasably fastened with bar member 236 as best seen in FIG. 18. In this regard, channel 238 preferably defines a plurality of apertures 262 that correspond in number to the plurality of recesses 248 and apertures 252 defined in body portion 240 of bar member 236. Apertures 262 extend between the top surface 256 and the bottom surface 258 of body 254. To assemble channel 238 and bar member 236, bar member 236 is placed within channel 238 such that apertures 252 are aligned with apertures 262, and mechanical fasteners 264 (e.g., a screw or bolt and nut 265) are secured through both apertures, for instance as shown in FIG. 20. A tether 266 (partially shown in FIG. 19) can be fastened to top surface 256 at one end and fastened to an interior wall of case 108, 124 (as shown in FIGS. 3-5) at the opposite end in order to retain locking bar 206 with case 108, 124 when locking bar 206 is not in use.

The locking bar 206 is movable between a locked position (FIGS. 2-5) wherein each end of the locking bar 206 is coupled with one of the distal portions 212 of sidewalls 205 of rear frame 202, and an unlocked position (e.g., FIG. 18) wherein the locking bar 206 is spaced apart from the distal portions 212. In various embodiments, any suitable mechanism can be used to couple locking bar 206 with rear frame 202 sidewalls 205. For example, at least one latch can be coupled with the locking bar 206 and configured to engage at least one latch plate coupled with one of the sidewalls 205 of rear frame 202.

In the illustrated embodiment, locking bar 206 defines a first end 268 and an opposite second end 270, and the at least one latch of locking bar 206 comprises a pair of right-angle clamps 272 respectively disposed at each end 268, 270. Clamps 272 can be secured to locking bar 206 via sets of apertures 274 defined in the body 254 of channel 238 and through which mechanical fasteners 276 (FIG. 21) are secured. In other embodiments, only a single clamp 272 or other latch is provided at one end 268 or 270, and the other end could be, for instance, pivotably coupled (e.g., via hinges) with a respective sidewall 205.

As will be understood, clamps 272 each comprise a handle 278 configured to move a U-shaped bar 280 between a lowered position, at which handle 278 can be generally perpendicular to top surface 256 of channel 238 and a raised position, at which a longitudinal axis of handle 278 can be approximately parallel with top surface 256 of channel 238 (see FIG. 18). Bars 280 are configured to engage catches 282 coupled with the distal portions 212 of each sidewall 205 (FIG. 14) when the bar is in the raised position in response to actuation of handle 278. As the bars 280 are moved to the raised position, locking bar 206 will be moved downward relative to rear frame 202 and sidewalls 205 to engage firearms 10 stored therein. In the illustrated embodiment, a coil spring 282 is disposed at each distal portion 212 such that they engage bottom surface 258 at each end 268, 270 of channel 238 when locking bar 206 is coupled with rear frame 202. Springs 282 thus can bias locking bar 206 toward the unlocked position, and actuation of handles 278 to raise bars 280 and to lock locking bar 206 with respect to rear frame 202 will act against the force of springs 282.

Based on the foregoing, it will be appreciated that embodiments of the invention provide improved equipment cases, firearm frame assemblies, and methods of using equipment cases. Among other things, embodiments of the present invention provide frame assemblies for storing a plurality of firearms in an equipment case that yield a number of improvements over existing foam inserts (whether customizable or otherwise). For instance, the frame assemblies of the present invention may be more rugged than foam inserts and less susceptible to being damaged by hard or sharp edges on firearms that are being repeatedly inserted or removed from the equipment case. Further, the relatively open configurations of frame assemblies of embodiments of the present invention are less likely to be damaged from firearms that are still hot when users store them shortly after being fired. Also, frame assemblies in accordance with the present invention are easier to clean and less likely to absorb contaminants then foam inserts. Finally, embodiments of the present invention store firearms more securely and firearms are less likely to move during transit than with foam inserts that rely upon compression between foam layers in order to secure firearms in place.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An equipment case for carrying firearms, the equipment case comprising:

a lid connected with a base to define an interior volume, the lid movable between a closed position, at which a peripheral surface of the lid engages a peripheral surface of the base, and an open position;

wherein the peripheral surface of the base lies on a first plane;

at least one frame assembly disposed in the interior volume and coupled with the base, the at least one frame assembly comprising:

a rear frame, the rear frame comprising a plurality of projections each dimensioned to receive a respective magazine well of a firearm and each defining a respective first projection axis, wherein each respective first projection axis lies on a second plane that extends at a nonzero angle to the first plane; and a front frame, the front frame comprising a plurality of seats dimensioned to receive a forestock of each respective firearm coupled with the rear frame;

wherein the rear frame comprises a pair of sidewalls disposed laterally of the plurality of projections, each sidewall defining a distal portion, and wherein the rear frame further comprises a locking bar, the locking bar movable between a locked position wherein each end of the locking bar is coupled with one of the distal portions, and an unlocked position wherein the locking bar is spaced apart from the distal portions; and wherein the locking bar defines a plurality of notches that are in facing opposition with the plurality of seats when the locking bar is in the locked position.

2. The equipment case of claim 1, wherein the base defines a recessed portion in an exterior surface of the base opposite the first plane, and wherein the at least one frame assembly is fastened to the base at the recessed portion using mechanical fasteners.

3. The equipment case of claim 1, wherein the front frame and the rear frame are separate from one another.

4. The equipment case of claim 1, further comprising a spring disposed between each distal portion and the locking bar.

5. The equipment case of claim 1, further comprising at least one latch coupled with the locking bar and configured to engage at least one latch plate coupled with one of the sidewalls.

6. The equipment case of claim 1, wherein the plurality of projections comprises five projections.

7. The equipment case of claim 1, wherein the nonzero angle is about ninety (90) degrees.

8. An equipment case for carrying firearms, the equipment case comprising:

a lid and a base, wherein the lid and base are connectable to one another to define an interior volume, wherein the equipment case defines a first lateral side, a second lateral side opposite the first lateral side, a front side, and a back side opposite the front side;

a first frame assembly disposed in the interior volume and coupled with the base, the first frame assembly comprising:

a first front frame comprising at least one seat engageable with a forestock of the first firearm; and a first rear frame comprising a plurality of projections engageable with a magazine well of a first firearm, a pair of sidewalls disposed laterally of the plurality of projections, each sidewall defining a distal portion, and a locking bar, the locking bar configured to be movable between a locked position wherein each end of the locking bar is coupled with one of the distal portions, and an unlocked position wherein the locking bar is spaced apart from the distal portions, the locking bar further defining a plurality of notches that are in facing opposition with the at least one seat when the locking bar is in the locked position; and a second frame assembly disposed in the interior volume and coupled with the lid, the second frame assembly comprising:

a second front frame comprising at least one seat engageable with a forestock of the second firearm; and a second rear frame comprising a plurality of projections engageable with a magazine well of a second firearm, a pair of sidewalls disposed laterally of the plurality of projections, each sidewall defining a distal portion, and a locking bar, the locking bar configured to be movable between a locked position wherein each end of the locking bar is coupled with one of the distal portions, and an unlocked position wherein the locking bar is spaced apart from the distal portions, the locking bar further defining a plurality of notches that are in facing opposition with the at least one seat when the locking bar is in the locked position.

9. The equipment case of claim 8, wherein the first rear frame and the second rear frame each define a respective longitudinal axis.

10. The equipment case of claim 9, wherein the respective longitudinal axes of the first rear frame and the second rear frame extend between the front side and the back side of the equipment case.

11. The equipment case of claim 9, wherein the respective longitudinal axes of the first rear frame and the second rear frame extend between the first and second lateral sides of the equipment case.

12. The equipment case of claim 8, wherein the first front frame is disposed between the first rear frame and the first lateral side of the equipment case, and wherein the second front frame is disposed between the second rear frame and the second lateral side of the equipment case.

* * * * *